US005671689A

United States Patent [19]

Clapp et al.

[11] Patent Number: 5,671,689

[45] Date of Patent: Sep. 30, 1997

[54] APPARATUS AND METHOD FOR MONITORING PREDETERMINED SEAM CHARACTERISTICS

[75] Inventors: Timothy G. Clapp, New Hill; Kimberly J. Titus, Raleigh; Adam B. Davis, Shelby, all of N.C.

[73] Assignee: North Carolina State University, Raleigh, N.C.

[21] Appl. No.: 611,077

[22] Filed: Mar. 5, 1996

[51] Int. Cl.[6] ..... D05B 19/00

[52] U.S. Cl. ..... 112/278; 112/475.02

[58] Field of Search ..... 112/278, 273, 112/470.03, 475.02, 272, 470.01, 475.01

[56] References Cited

U.S. PATENT DOCUMENTS

| | | | |
|---|---|---|---|
| 3,140,545 | 7/1964 | Murtland, Jr. | 33/147 |
| 3,680,215 | 8/1972 | Plough | 33/143 |
| 3,747,824 | 7/1973 | Linden | 112/21 X |
| 3,970,017 | 7/1976 | Babson et al. | 112/470.07 |
| 4,363,281 | 12/1982 | Reinke | 112/470.03 |
| 4,686,917 | 8/1987 | Braun | 112/311 |
| 4,815,015 | 3/1989 | Milne | 364/479 |
| 5,417,174 | 5/1995 | Allison et al. | 112/475.02 X |
| 5,513,590 | 5/1996 | Allison et al. | 112/470.03 X |

*Primary Examiner*—Peter Nerbun

*Attorney, Agent, or Firm*—Richard E. Jenkins, P.A.

[57] ABSTRACT

A sewn seam monitoring system for evaluating selected characteristics of seam formed from a plurality of fabric plies is disclosed comprising a vertically displaceable wheel for compressing and monitoring the thickness of a seam being sewn as the seam passes therebeneath and a transducer operatively connected to the wheel to measure vertical movement and generate a signal corresponding to the vertical displacement of the wheel. Computer means is electrically connected to the transducer for analyzing the seam being sewn to detect any defects therein sensed by the wheel when in compressing contact with the seam passing therebeneath.

29 Claims, 17 Drawing Sheets

APPARATUS AND METHOD FOR MONITORING PREDETERMINED SEAM CHARACTERISTICS

TECHNICAL FIELD

The present invention relates to a seam monitoring system for use in combination (either mounted on or positioned in operative proximity to) a sewing machine of the type adapted to stitch together seams formed from a plurality of plies of textile fabric. The seam quality monitoring system utilizes thickness sensing means to monitor the thickness of a sewn seam passing therebeneath and electrically connected computer means for analyzing the sewn seam to detect any defects therein.

RELATED ART

As is well known to those familiar with textile garment manufacturing, considerable effort must be made to maintain the quality of garment construction as garment manufacturing productivity continues to increase to an ever faster pace. While inspection of each sewn seam as it is constructed in a textile garment is essential, the inspection takes considerable time and can waste a sewing operator's time. The seam inspection becomes even more impractical as more and more seaming operations are automated in the garment industry. Thus, many times a faulty sewn seam (e.g., an improperly folded seam) is not detected through visual inspection by the sewing operator, and the defective garment becomes apparent only downstream when the seam causes a defect during the washing process, such as a "blowout" during stonewashing of denim garments. This problem is costly for the manufacturer since repairs on the garments with blown-out seams to render then marketable are quite time-consuming and expensive.

The greatest problem with detecting faulty seams resides with sewn seams that visibly appear satisfactory and yet do not contain adequate seam allowance and stuffing and hence suffer "blowout" or other problems during washing. Thus, there is a long-felt need for an automated and effective on-line seam quality monitoring system to evaluate sewn seams during or immediately after construction to detect defective seams.

DISCLOSURE OF THE INVENTION

In accordance with the present invention, applicant provides a seam monitoring system for evaluating seams formed on from a plurality of elements of sheet material, and comprising thickness sensing means for compressing and monitoring the thickness of a seam as the seam passes therebeneath. Computer means is electrically connected to the thickness sensing means for analyzing the seam to detect any defects therein. The seam monitoring system can be either mounted directly to a suitable sewing machine of the type adapted to stitch together seams or it can be utilized independently but in operative proximity to the sewing machine.

Also, applicant provides a method for monitoring predetermined characteristics of a seam with a monitoring system wherein the seam is formed from a plurality of elements of sheet material, including urging a vertically displaceable roller against the seam and compressing the seam as the seam passes therebeneath, detecting the vertical displacement of the roller as the seam passes therebeneath and generating a signal corresponding thereto, and analyzing the signal with computer means to detect predetermined characteristics along the length of the seam.

Thus, it is an object of the present invention to provide an automated system for easily and reliably monitoring sewn seams and detecting defects therein.

Some of the objects of the invention having been stated hereinabove, other objects will become evident as the description proceeds, when taken in connection with the accompanying drawings as best described hereinbelow.

BEST MODE FOR CARRYING OUT THE INVENTION

Experimental Testing

Figure 1:
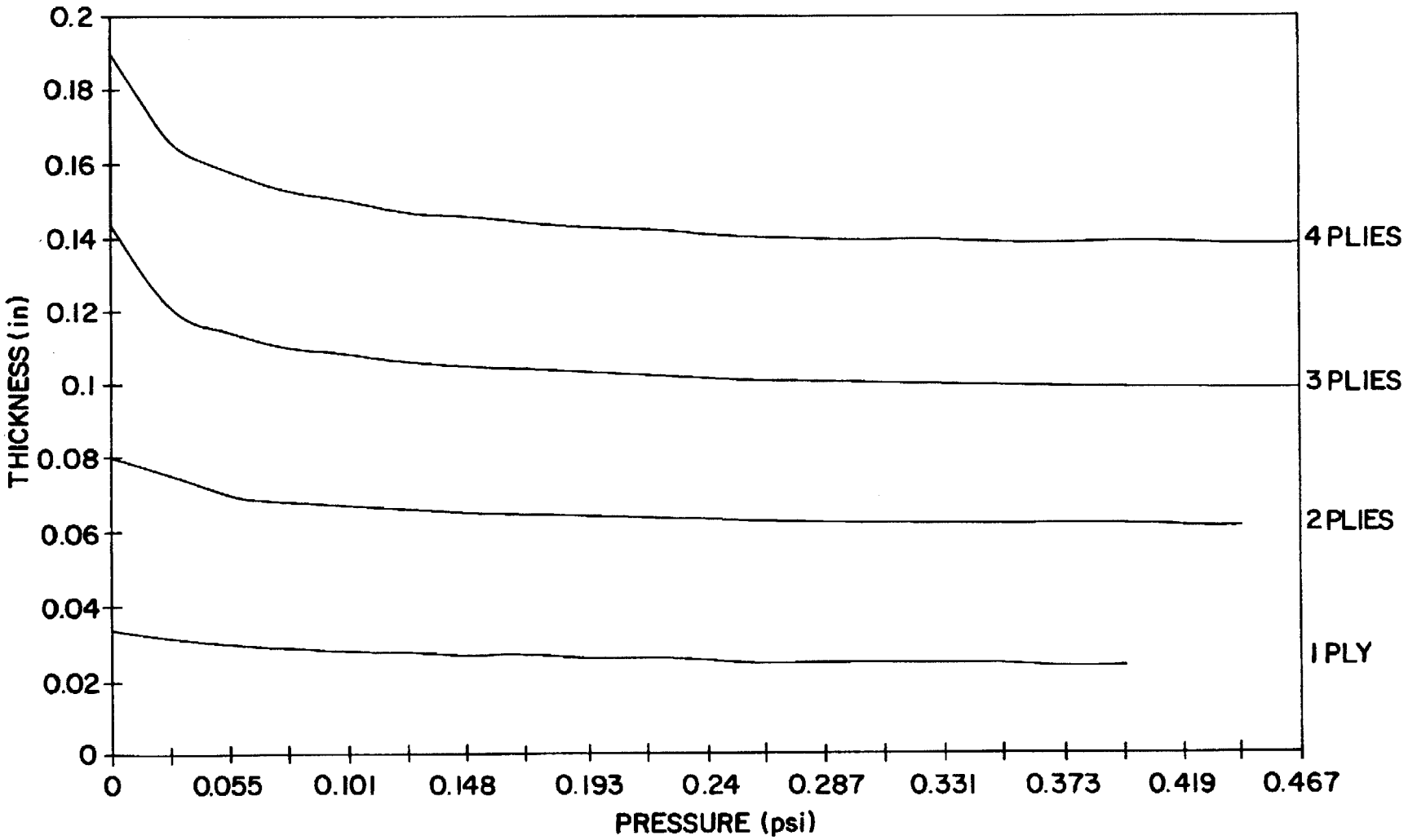
FIG. 1 is a graph of sample thickness versus compressed pressure curves for 1, 2, 3 and 4 plies of denim fabric.

By way of background explanation of the instant invention, it should be appreciated that applicants' initial development of the rolling wheel concept for automated inspection of sewn seams included an investigation of fabric compression and decompression characteristics. Ply thickness measurements were collected under various pressures for denim samples using a SCHIEFER brand Compressometer. Employing a 3.0 inch diameter presser foot, the pressure applied to a sample was slowly increased up to approximately 0.5 lbs./in.$^2$ (3.5 lbs.) and then slowly removed until the sample was fully decompressed. Sample thickness versus pressure curves for 1, 2, 3 and 4 plies of denim fabric are shown in FIG. 1. Applicants discovered that during the initial compression of each sample, the thickness rapidly decreases and then stabilizes as it approaches a compression limit. At any given pressure, the number of layers within a sample can be clearly distinguished.

Figure 2:
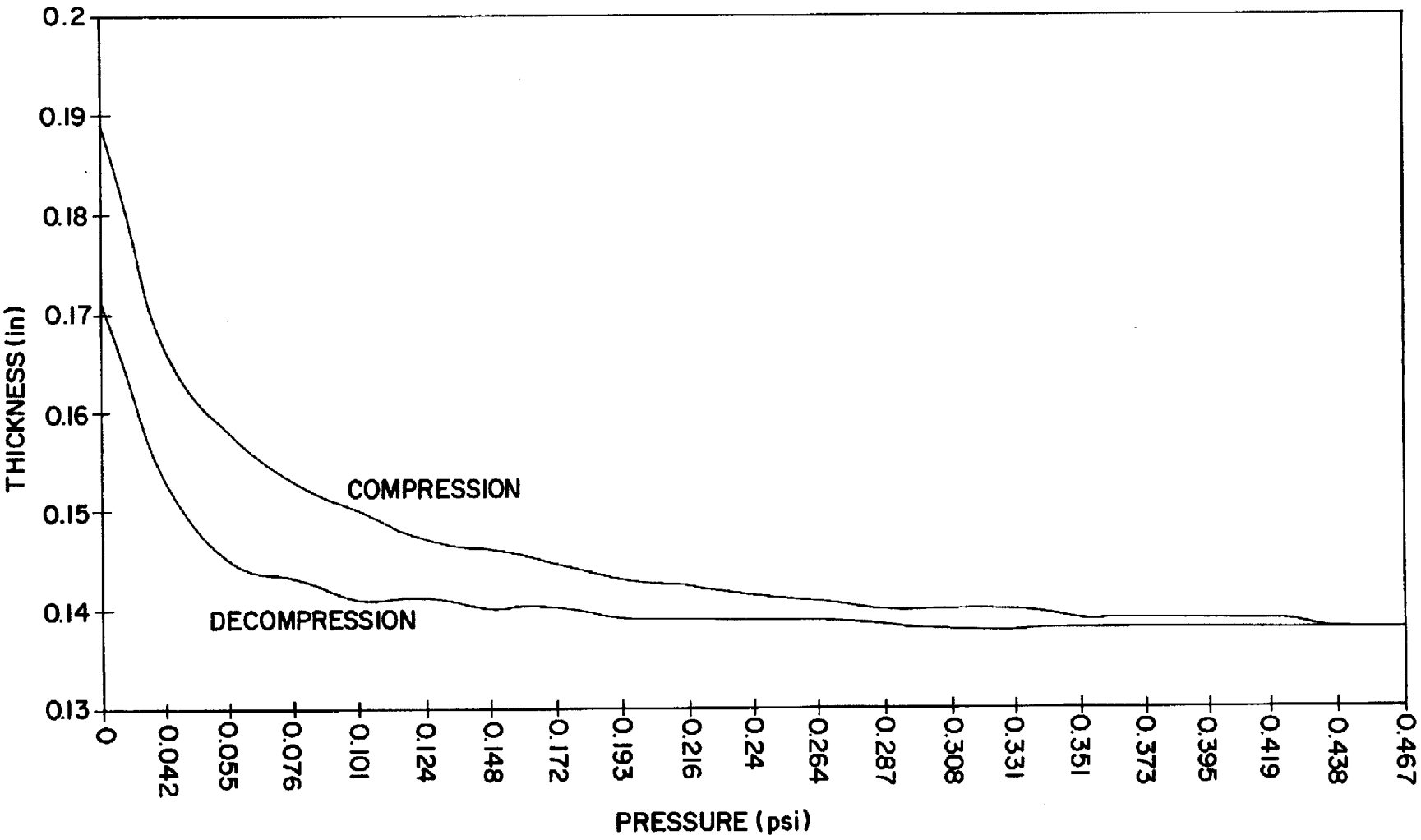
FIG. 2 is a graph of the compression and decompression characteristics for 4 plies of denim fabric.

The compression and decompression characteristics for four plies of denim fabric are described by FIG. 2. While the thickness rapidly decreases and then stabilizes as the pressure is applied, it can be seen that it does not immediately return to its previous state as the pressure is removed. The sample remains partially compressed. This effect on the sample thickness is known as "hysteresis", a change in the sample thickness at a given pressure due to a previous application of force. The characteristics shown describe a 9.5% hysteresis effect as the four denim fabric layers return to only 90.5% of their original thickness.

Figure 3:
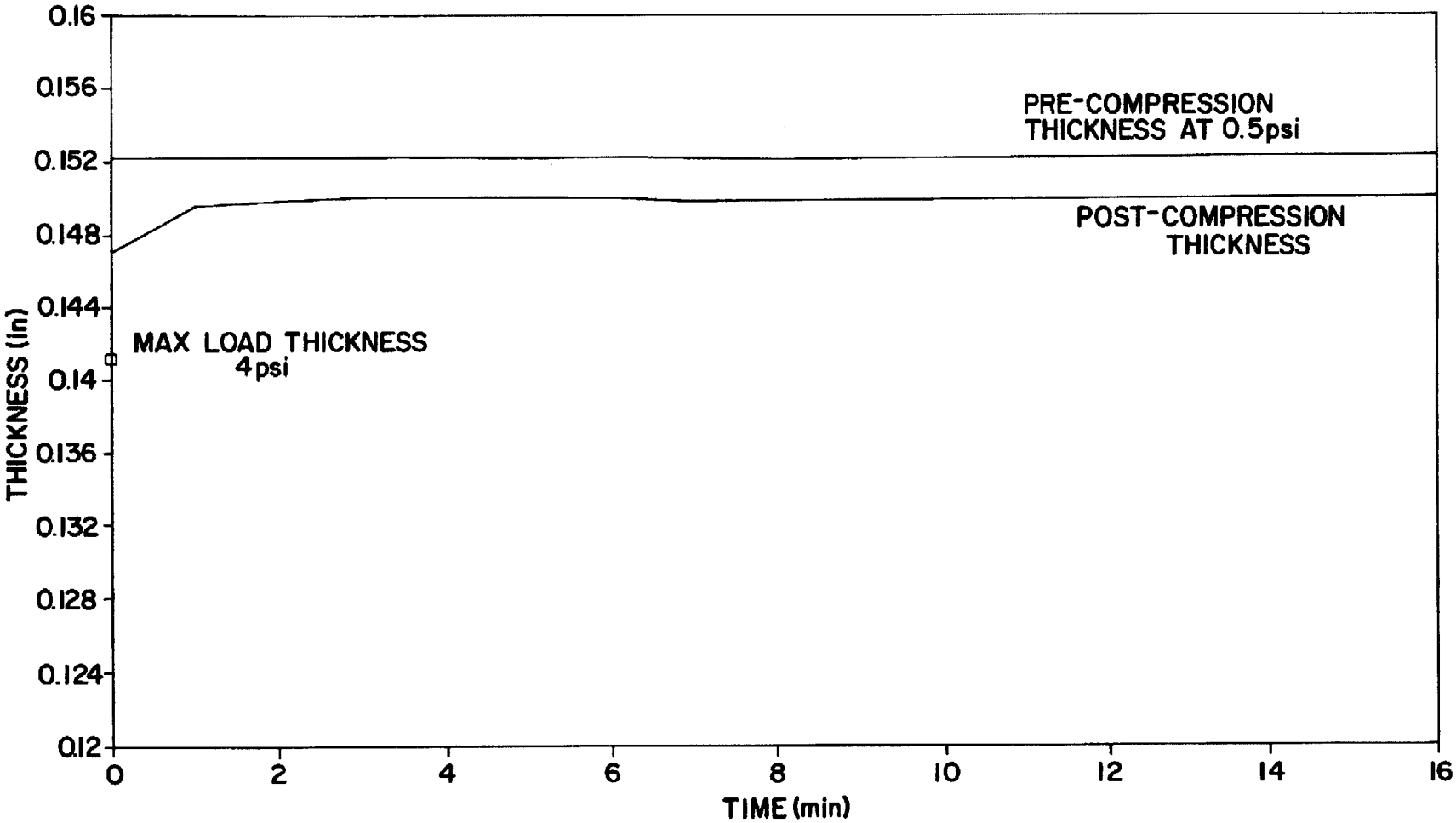
FIG. 3 is a graph of time-dependent decompression of 4 plies of denim fabric.

Fabric decompression is a time-dependent process, and given sufficient time, a sample will eventually return to its original state unless compressed to the point of damage. The Compressometer, equipped with a 1.0 inch diameter presser foot, was also used to study the decompression of denim fabric as a function of time. Four plies of 14.9 oz. denim fabric were compressed under 4.0 psi, corresponding to a force of 3.1 lbs., before the pressure was removed. Measurements recorded at 0.5 psi every one to two minutes indicate the rate at which the sample returned to its original state. As indicated in FIG. 3, the sample's thickness returned to 98.7% of its original value within approximately three minutes, reducing the "hysteresis" effect from 9.5% to 1.3%. This suggested that compression of the fabric by applicants' sewing seam monitoring apparatus should have no lasting effect provided the force is not too great.

Figure 4:
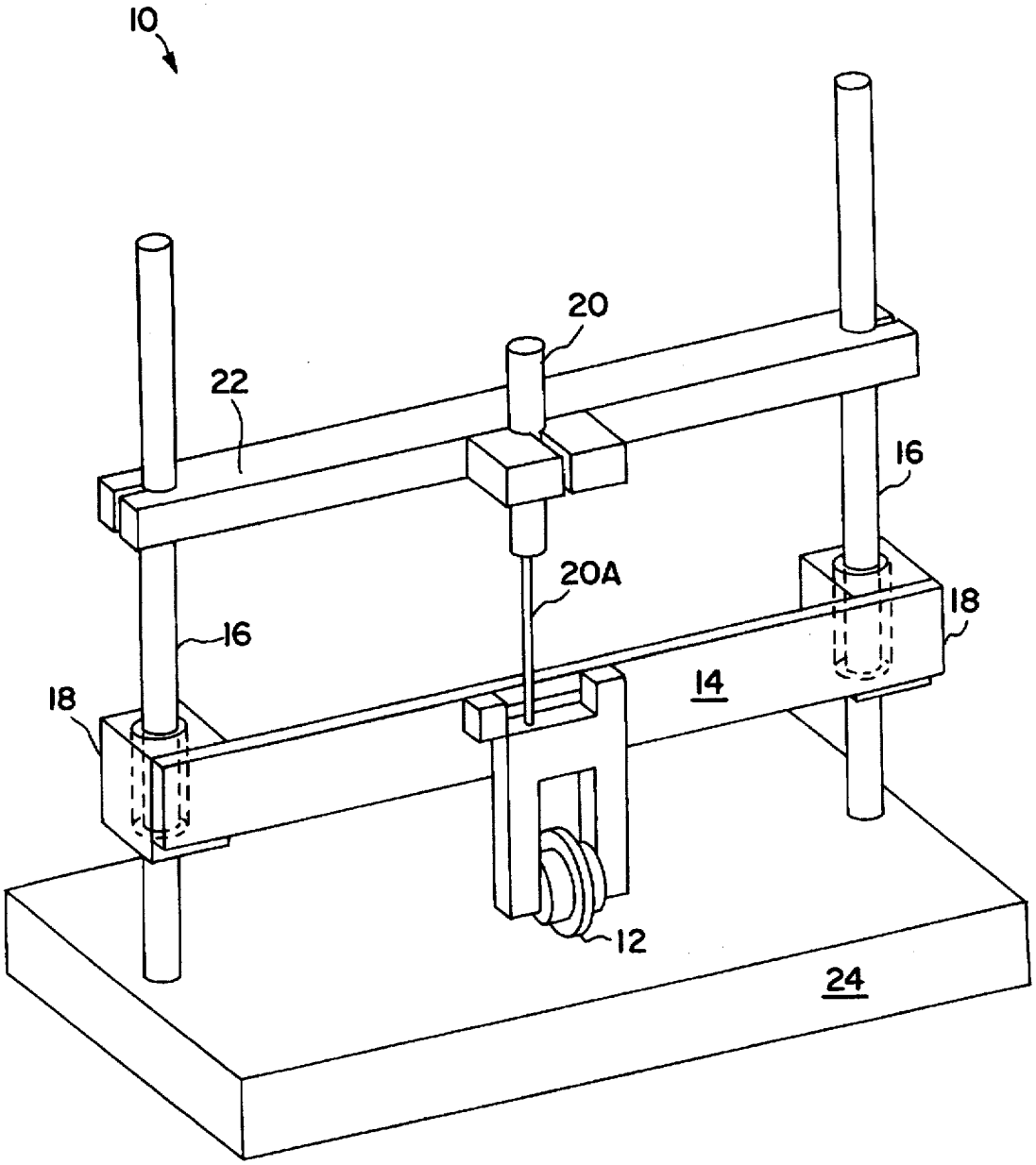
FIG. 4 is a perspective view of a laboratory prototype of the invention.

A preliminary prototype apparatus was designed and built at the North Carolina State University College of Textiles in Raleigh, N.C. and is illustrated in FIG. 4 (generally indicated as 10). A 1.25 inch diameter flat edge aluminum wheel 12 is mounted on translating beam 14 supported by a linear bearing shaft 16 at each end thereof. Linear bearings 18 attached to each end of translating beam 14 allow wheel 12 to move vertically with minimal friction. Additional weight may be added on beam 14 to increase the amount of force on a fabric sample. The displacement of wheel 12 and translating beam 14 are measured from the voltage output of a SCHAEVITZ brand Model No. MHR250 LVDT (linear variable differential transducer) 20.

The cylindrical body of LVDT 20 is mounted on stationary support beam 22 above the moving beam of wheel 12 which serves as a reference point for LVDT 20 output. Core 20A of LVDT 20 is mounted to translating beam 14 such that it can move freely within the center aperture of the LVDT body when wheel 12 and beam 14 move vertically. The movement of core 20A creates a change in the magnetic field of LVDT 20. This change is output by LVDT 20 as a small voltage, and the signal is conditioned and amplified by a SCHAEVITZ brand Model No. ATA101 analog amplifier (not shown) to provide the final voltage reading which corresponds to the displacement of core 20A. The voltage change is linear with respect to the displacement of core 20A so that the output voltage can be multiplied by a constant to determine the actual fabric sewn seam thickness measurement in inches, etc. (Although not utilized in the experimental prototype, the two commercial embodiments of the invention described hereinafter and shown in FIGS. 6A, 6B and 17 use a suitable programmed computer to analyze the signal from the LVDT.)

Figure 5A:
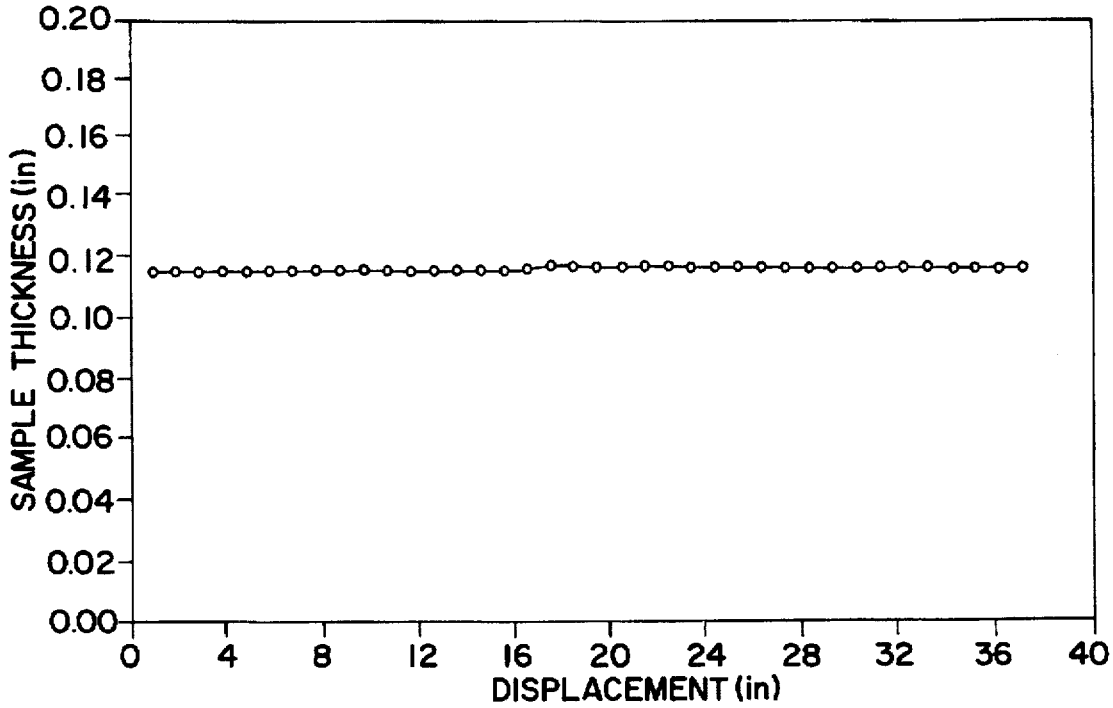
FIG. 5A is a graph of thickness data from a satisfactory felled denim seam.
Figure 5B:
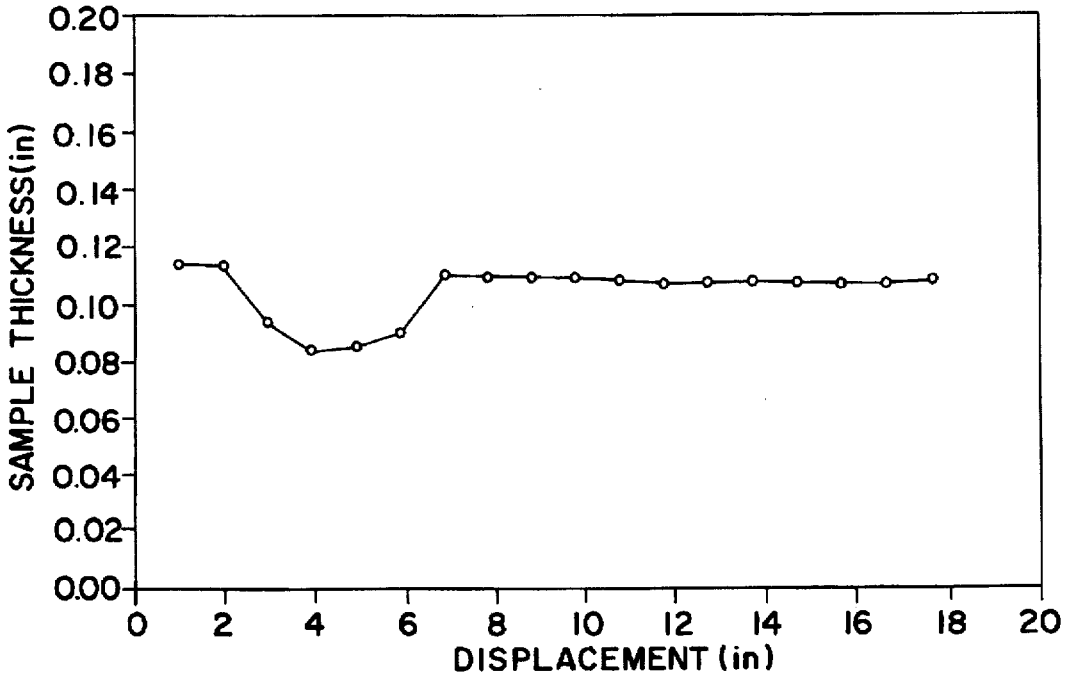
FIG. 5B is a graph of thickness data from a felled denim seam in which the fourth ply has slipped out so as to expose a raw edge.

The constant by which to convert the voltage output from LVDT 20 to a thickness measurement for preliminary prototype 10 was determined from the calibration of LVDT 20. The LVDT reading was zeroed at reference platform 24 and other voltage-thickness readings were obtained using feeler gauges. Data from two representative seams is illustrated in FIG. 5. The first corresponds to an acceptable felled seam containing 4 plies of denim fabric, while the second depicts a felled seam in which the fourth ply has slipped out, exposing a raw edge. The preliminary prototype demonstrated that these two situations can be clearly indicated by mechanical wheel apparatus 10.

To evaluate the potential of apparatus 10 to produce damage resulting in residual marks after laundering, a denim pant leg consisting of 6 felled seams was fabricated. Each seam was pulled through apparatus 10 with wheel 12 applying a given force to the center of the seam. In addition to the mass of apparatus 10 itself, weights were added to increase the force applied by wheel 12. Total applied weight was varied in increments of 2 lbs. to 15 lbs. from one seam to the next, corresponding to a pressure range of approximately 100 to 300 lbs/in$^2$(psi). Careful examination of the denim fabric sample after stonewashing indicated that visual damage to the seam was negligible. Shading and blemishes appeared identical in quality and randomness as those on untested denim stonewashed garments.

First Embodiment of the Invention

Figure 6B:
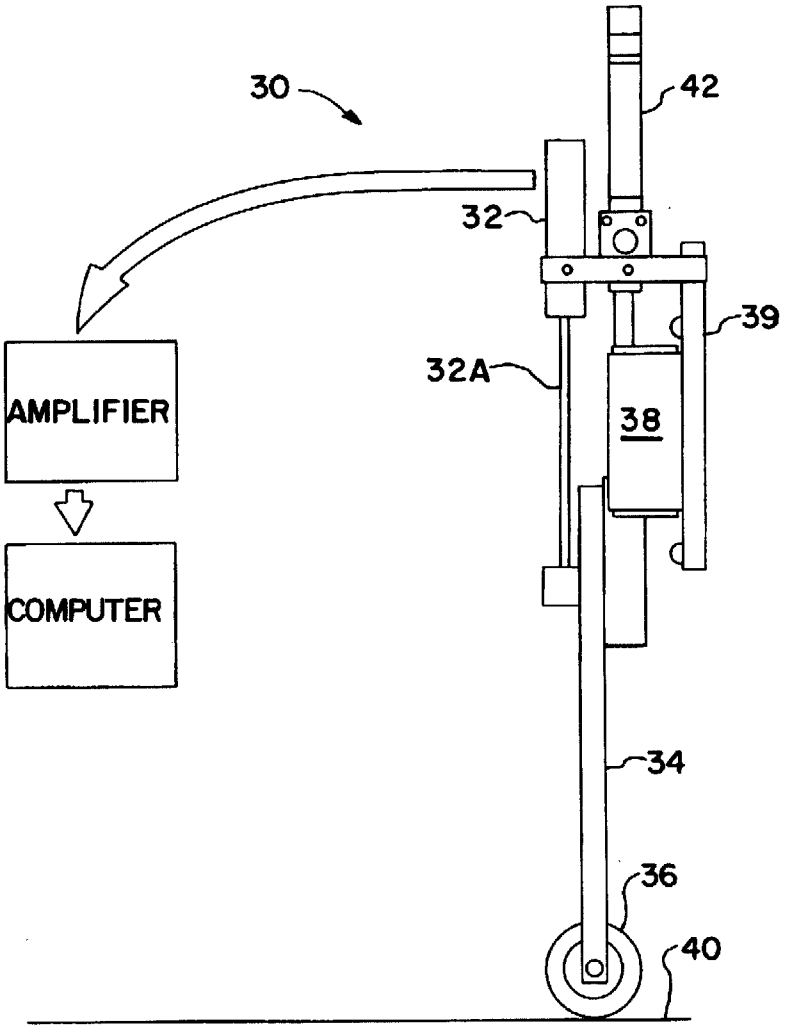
FIG. 6B shows a side elevation view of the first embodiment of the invention in its operative mode.
Figure 6A:
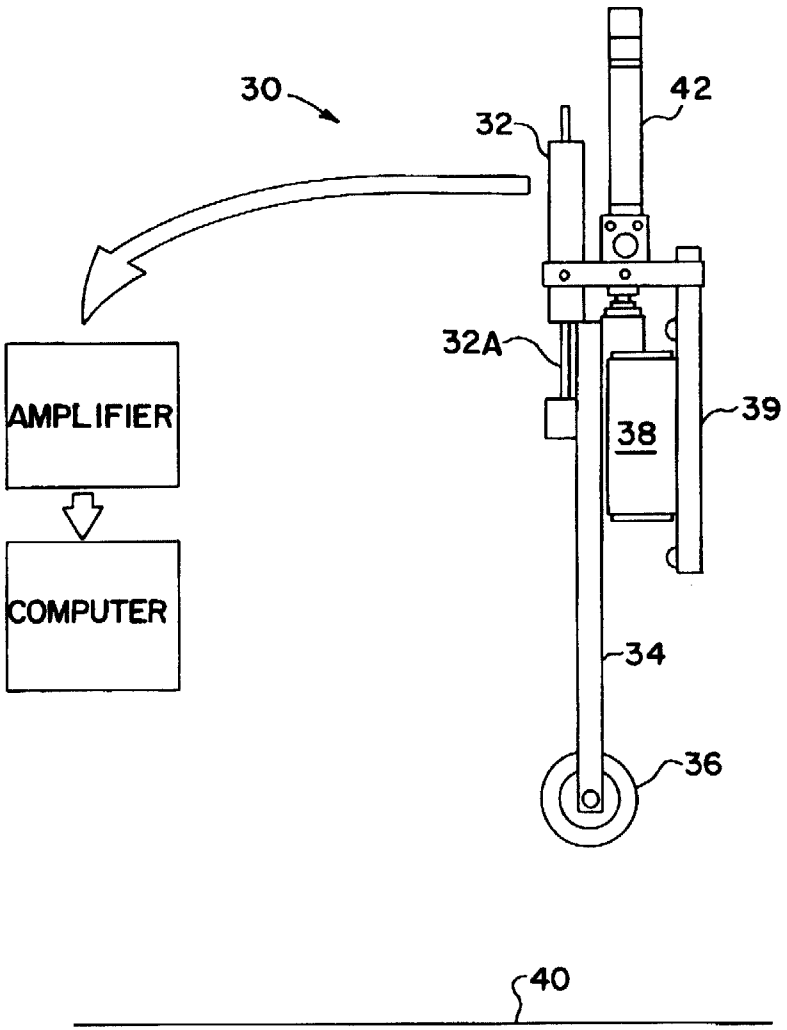
FIG. 6A shows a side elevation view of a first embodiment of the invention positioned in its inoperative mode.
Figure 17:
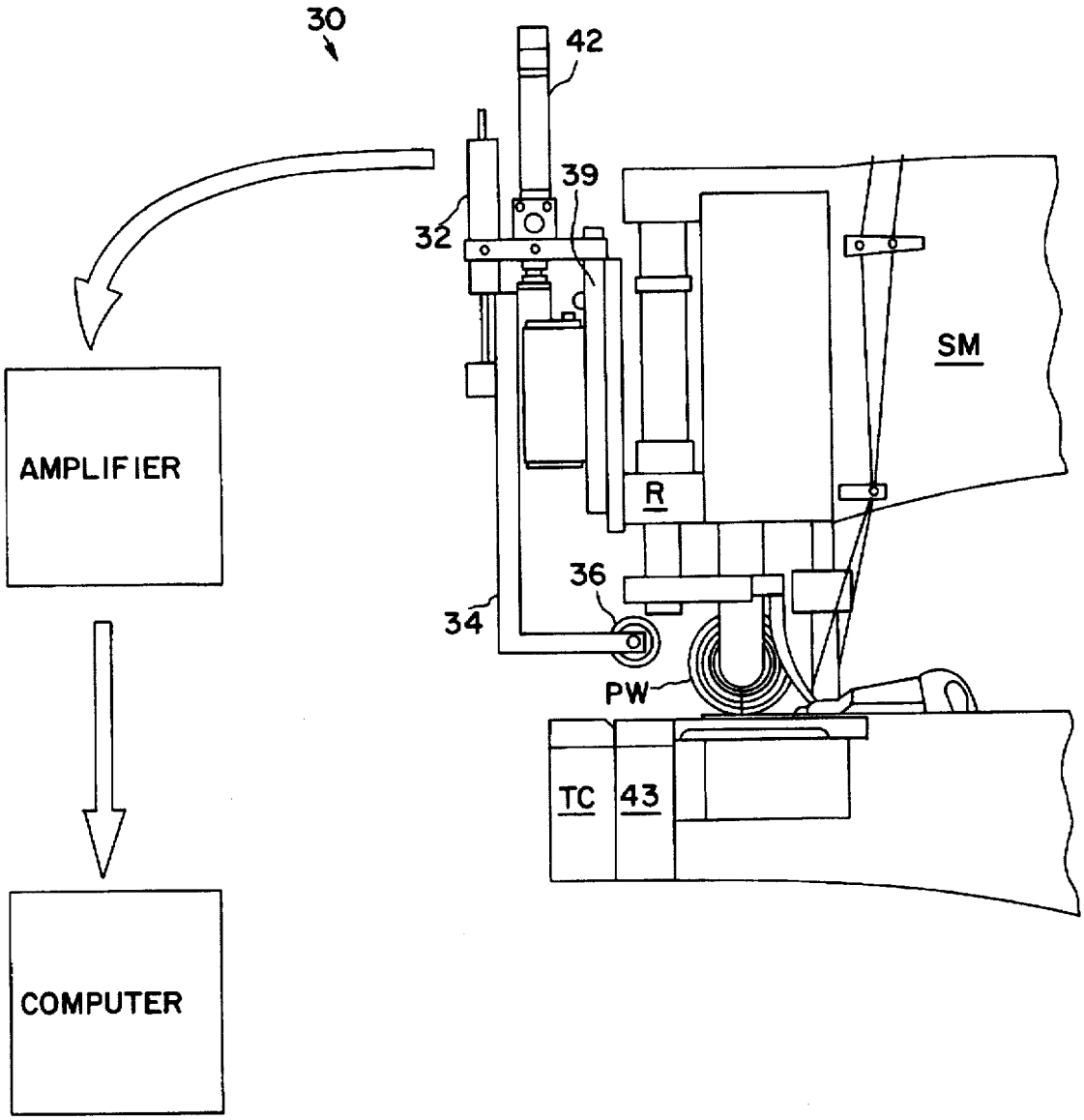
FIG. 17 shows a side elevation view of a second embodiment of the invention wherein the apparatus shown in FIGS. 6A and 6B is directly mounted to a sewing machine.

The first embodiment of the automatic sewn seam quality monitoring apparatus of the invention was designed as a portable benchtop unit which, optionally, could be mounted on the end of a side arm sewing machine (FIG. 17). The design of the benchtop unit is illustrated in FIGS. 6A and 6B and is generally designated 30. As with the preliminary prototype described hereinabove, the body of LVDT 32 is mounted in a stationary vertical position while its core 32A is attached to wheel bracket 34. However, as an improvement from the experimental device, aluminum wheel 36 is 1.0 inch in diameter, contains a Teflon bearing (not shown), and has a beveled edge to better approximate the thickness at the center of a seam. Wheel bracket 34 is attached to a ball slide 38 (secured to mounting plate 39) which is lowered to reference plate 40 by a 0.3125 inch diameter air cylinder 42. Air cylinder 42 is adjusted to engage with some hesitation so that wheel 36 lowers slowly. The impact of wheel 36 with reference plate 40 is thus minimized to reduce damage to a fabric seam therebeneath or to the wheel edge.

Although wheel 36 is shown in FIGS. 6A and 6B (as well as FIG. 17) as mounted for direct upward vertical movement by vertical displacement of wheel bracket 34 affixed to LVDT core 32A, applicants contemplate that wheel 36 could also be mounted on a lever arm or the like (not shown) so as to deflect vertically upwardly through an arc or other two or three dimensional vertical movement that is detected by operatively connected LVDT 32.

The signal from LVDT 32 is conditioned and amplified with a SCHAEVITZ brand Model No. ATA101 analog amplifier with a calibration coefficient determined in the same manner as the experimental prototype. The LVDT reading was zeroed at reference plate 40 and feeler gauges were used to obtain other voltage-thickness readings. Data were fit using linear regression which yielded a slope of 0.101 inches/volt.

The force applied to a fabric seam can be controlled by regulating the air pressure applied to air cylinder Table 1 below illustrates the conversion of gauge pressure applied to air cylinder 42 to the pressure applied to a seam by wheel 36.

The equivalent force is calculated from the estimated surface area of wheel 36 which makes contact with a fabric sample.

TABLE 1

Equivalent Force and Pressure Exerted

| Gauge Pressure (psi) | Equivalent Force (lbs.) | Pressure (Applied) to Seam (psi) |
|---|---|---|
| 4.0 | 0.308 | 25.7 |
| 6.0 | 0.462 | 38.5 |
| 8.0 | 0.616 | 51.4 |
| 12.0 | 0.924 | 77.0 |
| 16.0 | 1.232 | 89.9 |

Apparatus 30 is compact and with the exception of the amplifier may be enclosed in a 1.75 inch×5.0 inch×2.50 inch housing (not shown). Wheel 36 and bracket 34 extend 4.0 inches beyond the housing to make contact with the fabric sample.

To maintain a constant feed rate of a fabric such as denim through apparatus 30 for testing purposes, a motor-driven tractor feed system (not shown) was constructed. A front pulley supporting a drive belt is lowered onto reference plate 40 by an air cylinder when apparatus 30 is engaged. Motor drive rates of 2 to 10 were converted to inches of material feed through the system per minute, ranging from 22.2 to 153.4 in./min. Apparatus 30 is in no respect limited to this range of feed rates, but rather is capable of operating at "normal" sewing operating conditions up to 500 in./min or more, as for a 2-needle chainstitch machine producing 8 SPI at 4000 SPM.

Finally, and very importantly, applicants contemplate that the analog amplifier of apparatus 30 is interfaced to a computer (e.g., a PC) using a NATIONAL INSTRUMENTS brand LabVIEW® software package. LabVIEW®, a graphical programming language, is convenient, easy-to-use, and highly effective for demonstration and research purposes. The front panel of a "virtual instrument" that can be created contains controls for the feed rate, resolution, and gain adjustment. These parameters are set by the user and serve as inputs to the program. The voltage output from the amp is converted to inches according to the coefficient determined from the LVDT calibration and is graphed in real-time. To facilitate data collection and analysis, the data can be saved to a spreadsheet. The user can be prompted to specify a file name or cancel the option if desired. Alternatively, LVDT 32 can be connected directly to a suitable microprocessor to monitor sewn seam quality and, optionally, to control selected sewing functions.

Method of Use of the Invention

Applicants have conducted and completed considerable testing of apparatus 30. This includes investigation of unsewn plies and sewn felled seams as well as the evaluation of variables such as the pressure exerted on the sample, the feed rate, and the variation in fabric properties.

Figure 7:
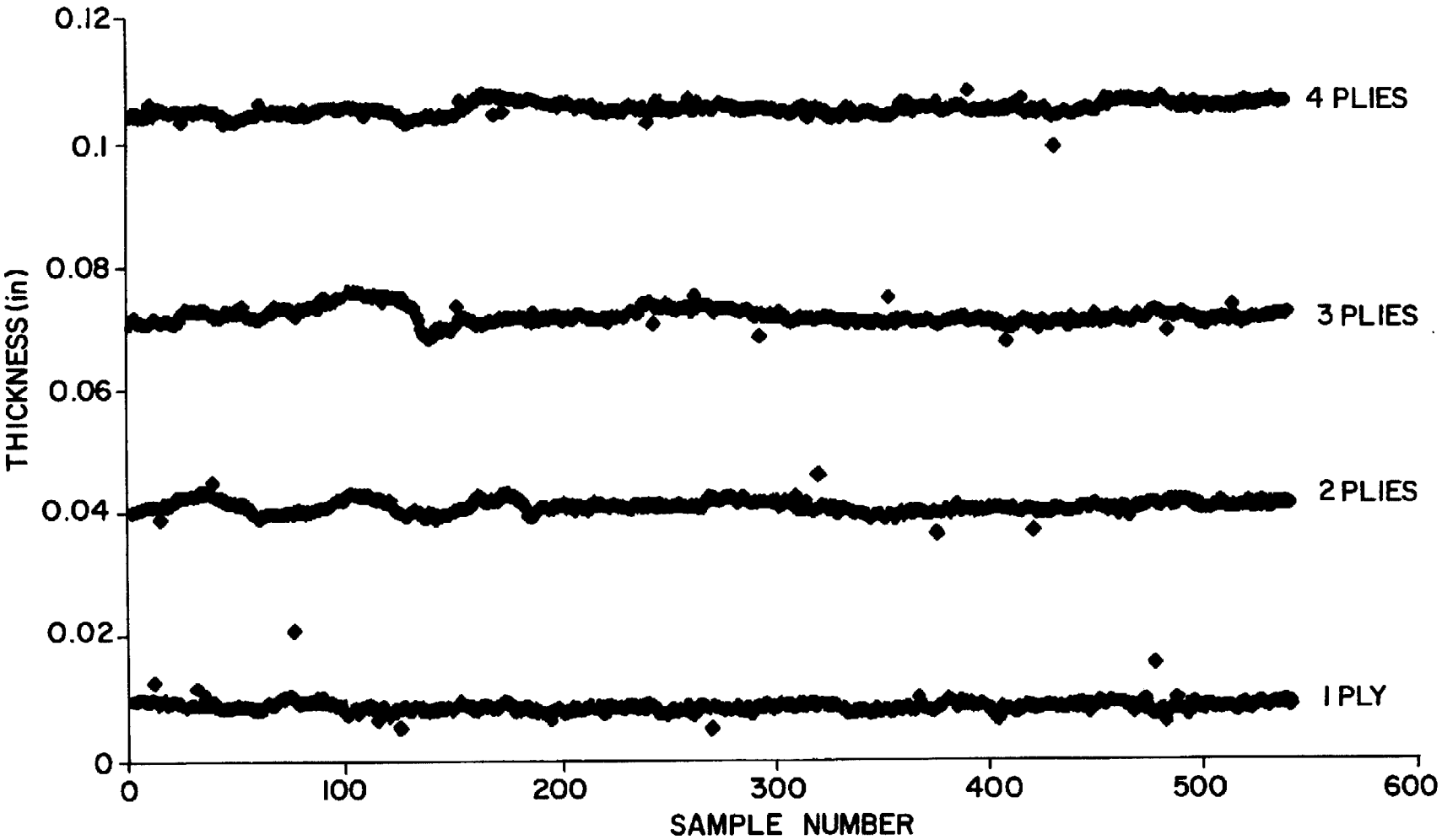
FIG. 7 is a graph of thickness of unsewn fabric samples comprising 1, 2, 3 and 4 plies of denim fabric.

Prior to investigating sewn seams, the characteristics of unsewn plies were evaluated. Samples were fed through apparatus 30 (by the test purpose tractor feed system) and approximately 540 data points were collected per sample. FIG. 7 illustrates a typical spectrum for 1, 2, 3 and 4 plies of 14.9 oz. black denim fabric. Average thickness measurements and standard deviations are listed in Table 2. As indicated by the thickness data, the single or top layer of denim experiences the greatest impact from the applied pressure, since 2, 3 and 4 ply thickness are not multiples of the 1 ply thickness. The CVs, or coefficients of variation, are within 2.5% of the average for multiple plies. Applicants interestingly note that the standard deviations are almost consistent, regardless of the number of plies, lending to the 11% CV for a single ply. This may indicate that any deviation is due to the surface roughness of the specific twill denim tested. However, data points for the various number of layers are well beyond 4 standard deviations of the other averages, indicating a clear distinction between the thicknesses. This distinction is critical to the efficacy of the invention.

TABLE 2

Unsewn Ply Thickness Characteristics

| Number of Plies | Average Thickness (inches) | Standard Deviation (inches) | Coefficient of Variation, % CV |
|---|---|---|---|
| 1 | 0.0085 | 0.00093 | 11 |
| 2 | 0.0409 | 0.00100 | 2.4 |
| 3 | 0.0721 | 0.00135 | 1.9 |
| 4 | 0.106 | 0.00095 | 0.90 |

The density of points collected, approximately 24.3 points/inch, is solely for experimental testing purposes. Obviously, fewer data points would be necessary for on-line industrial monitoring. Based upon the evaluation of apparatus 30, a seam would need monitoring approximately every 0.125 inches to 0.25 inches rather than the current 0.041 inches. Applicants have determined that, preferably, edge monitoring should occur at least once per inch of material movement.

Figure 8:
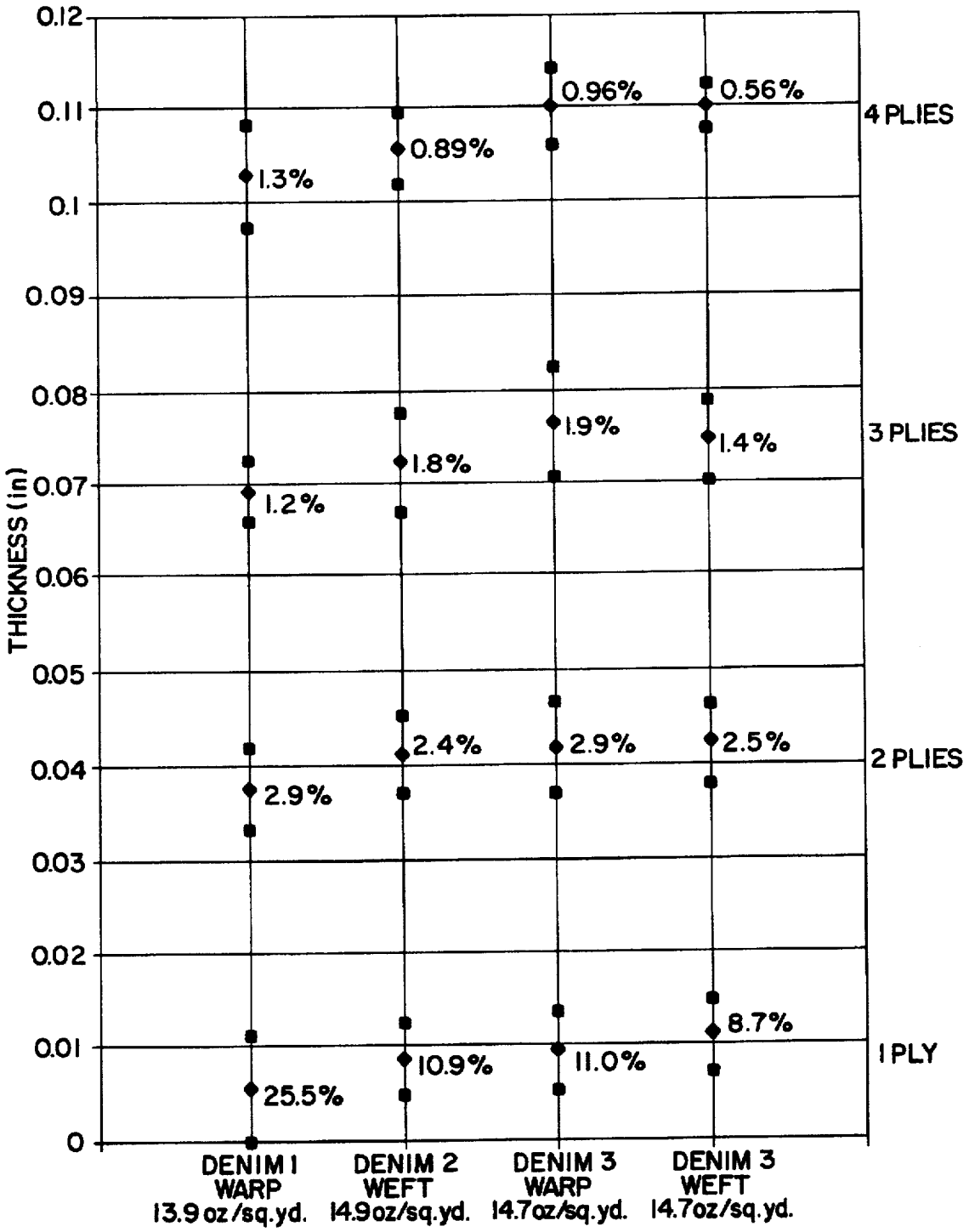
FIG. 8 is a graph illustrating variations in the average thickness in the warp and weft directions.

Thickness measurements between different denim samples exhibited some variation. This observation was first attributed to a variation in the physical properties of the denims, which had a weight range from 13.9 to 15.6 oz/yd$^2$. Also, some samples were cut along the warp and others along the weft, making a difference in which yarns are predominantly crossed by the wheel. The correlation between denim weight and thickness was investigated. FIG. 8 depicts the variations in average thickness in the warp and weft direction for various weight denim. On the average, CVs for samples cut and tested along the warp were slightly higher, which was attributed to a difference in surface roughness along the two directions for a twill weave.

Figure 9:
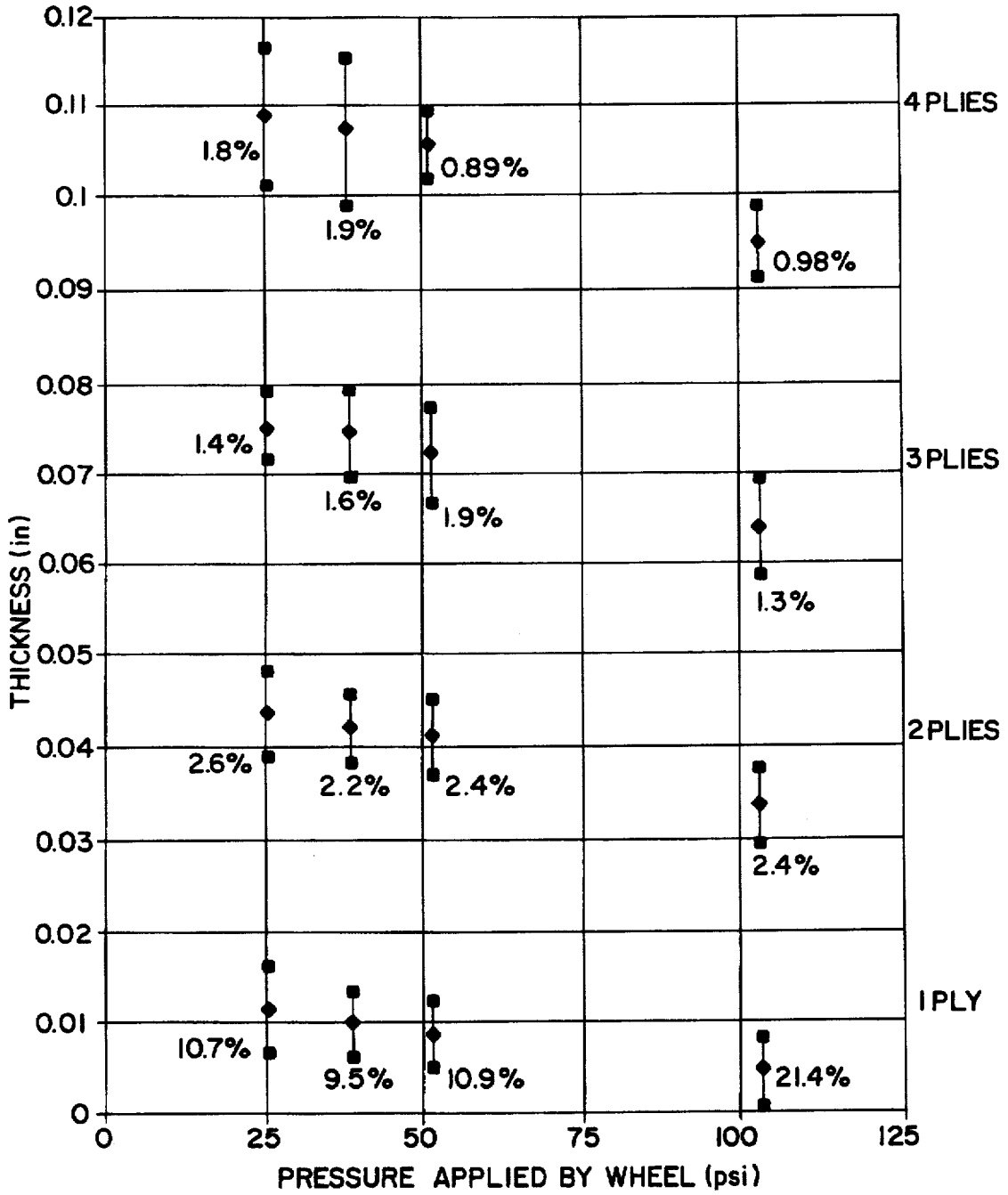
FIG. 9 is a graph depicting average thickness versus pressure for 1, 2, 3 and 4 unsewn denim plies.

The pressure applied by wheel 36 of apparatus 30 was optimized using unsewn plies of 14.9 oz/yd$^2$ denim. Thicknesses were monitored using gauge pressures of 4, 6, 8 and 16 psi. Using the applied pressures listed in Table 1, the variation in average thickness with pressure for 1, 2, 3 and 4 plies is illustrated in FIG. 9. The data are once again well beyond four standard deviations of each average thickness throughout the range of pressures considered. For wheel pressures above 60 psi, plus or minus 4 standard deviations from the average of one ply of denim for some fabrics coincided with the zero reference point. Thus, a pressure of approximately 50 psi, a force of 0.62 lbs., was selected for testing conditions.

Once unsewn denim plies were evaluated, data was collected for a selection of felled seams. Average thickness for 3 and 4 plies of fabric contained within the sewn seams were approximately 5–10% lower than their unsewn counterparts, due most likely to the compression of the layers from the two rows of chainstitching. The following seams were inspected visually and compared with spectra from the apparatus 30 and often one row of chainstitching was removed to accomplish a thorough evaluation. Representative felled seam data plots are shown in FIGS. 10 through 15. Each of the seams is described in detail below.

Figure 10:
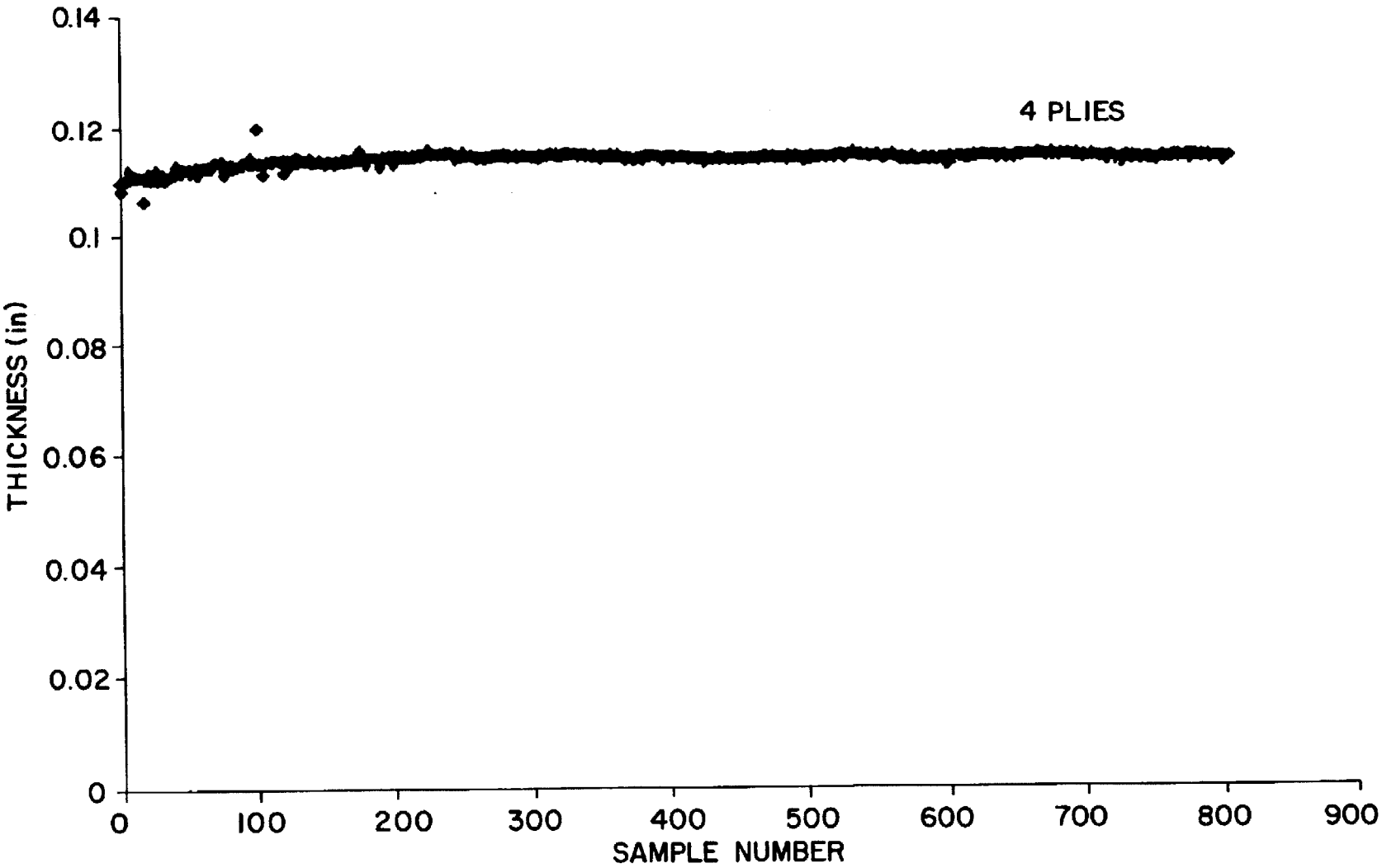
FIG. 10 is a thickness graph of an ideal felled denim seam.

FIG. 10: An Ideal Felled Seam

The felled seam is an ideal felled seam, containing four layers of denim throughout the entire length of the sample. Visually, the seam is extremely flat and uniform. Physical inspection and apparatus 30 analysis both confirm the "perfect" condition of the seam.

Figure 11:
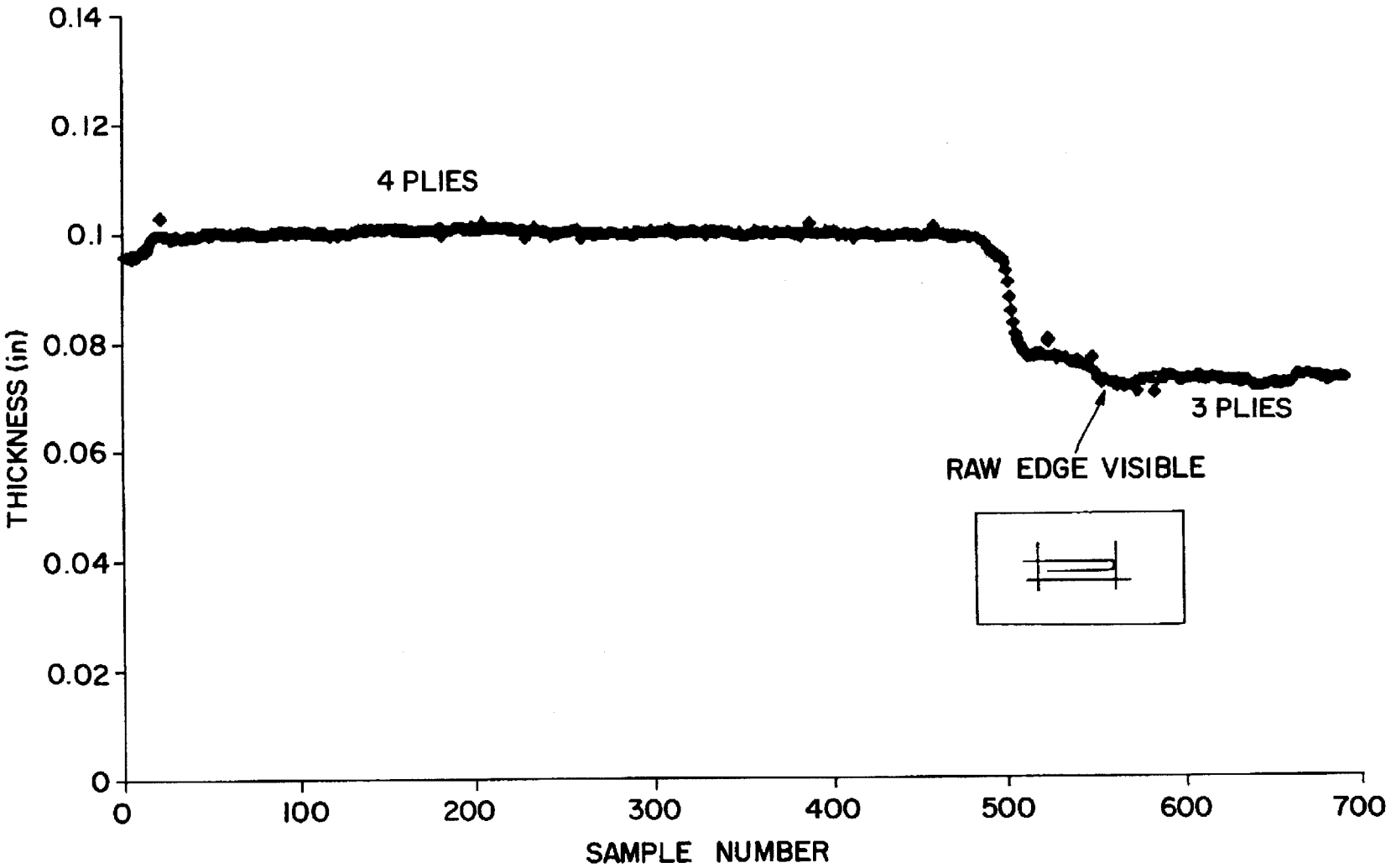
FIG. 11 is a thickness graph of an unacceptable felled denim seam with an exposed raw edge.

FIG. 11: An Unacceptable Felled Seam with Exposed Raw Edge

On the other extreme, this felled seam easily fails visual inspection. While half of the seam appears acceptable, the other contains a raw edge which has obviously slipped out to yield a faulty specimen. As illustrated by apparatus 30 data, the deviation of the edge within the seam is clearly indicated, long before the raw edge is visible.

Figure 12:
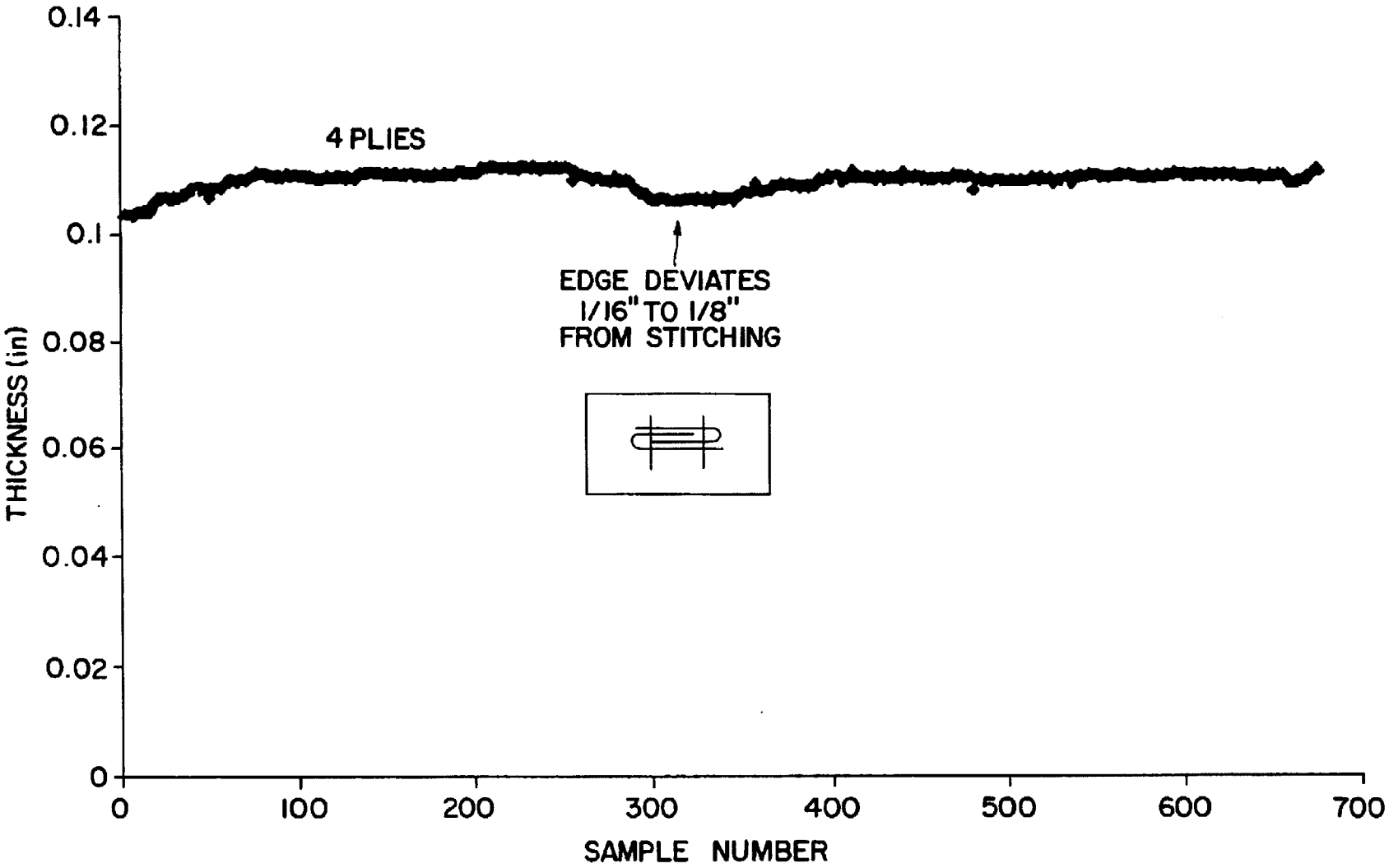
FIG. 12 is a thickness graph of an acceptable felled denim seam in minimal danger of "blowout"

FIG. 12: An Acceptable Felled Seam in Minimal Danger of Blowout

The felled seam visually appears to be formed and stitched correctly. The discrepancy illustrated in the spectrum suggests some deviation from ideal. Inspection of the open seam confirms that one edge has deviated approximately 0.0625 inches to 0.125 inches from the second stitching, not enough to create a problem after stonewashing, but valuable information for the operator. Such a slight deviation could provide feedback to the sewing machine operator to prevent a fault from occurring. This trial indicates the sensitivity of which LVDT 32 is capable.

Figure 13:
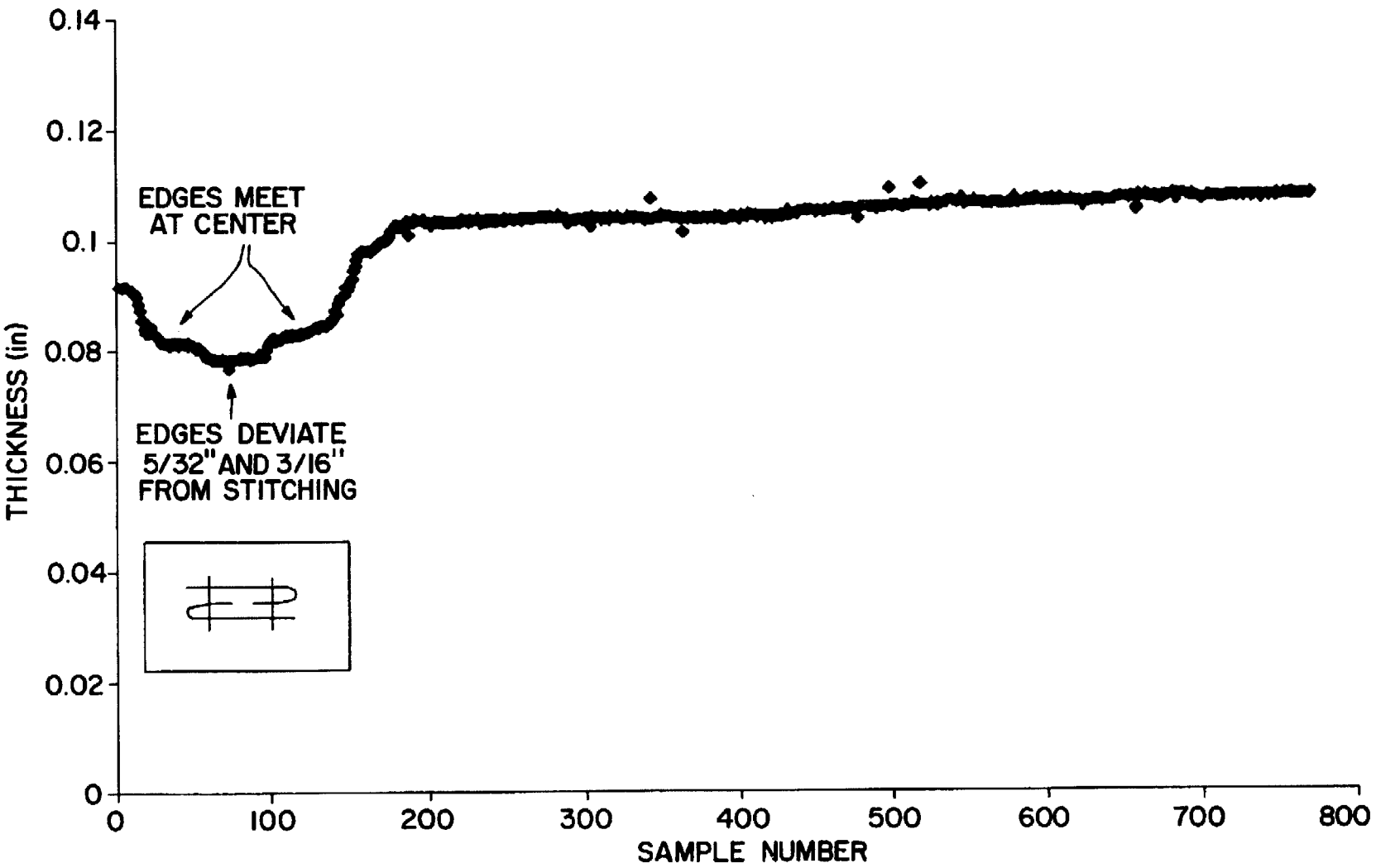
FIG. 13 is a thickness graph of a visually acceptable felled denim seam in danger of "blowout"

FIG. 13: A visually Acceptable Felled Seam in Danger of Blowout

The felled seam also appears to be folded and stitched correctly, however, apparatus 30 has indicated that this is not the case. FIG. 13 indicates that an area of the seam contains far less than 4 plies of denim although no raw edges are visable. Physical inspection of seam confirms that at its worst point, the edges within the stitching deviate 0.156 inches and 0.187 inches from their corresponding second rows of stitching, leaving an approximately 0.0625 inch gap between them. This seam would be in significant danger of blowing out in the stonewashing process.

Figure 14:
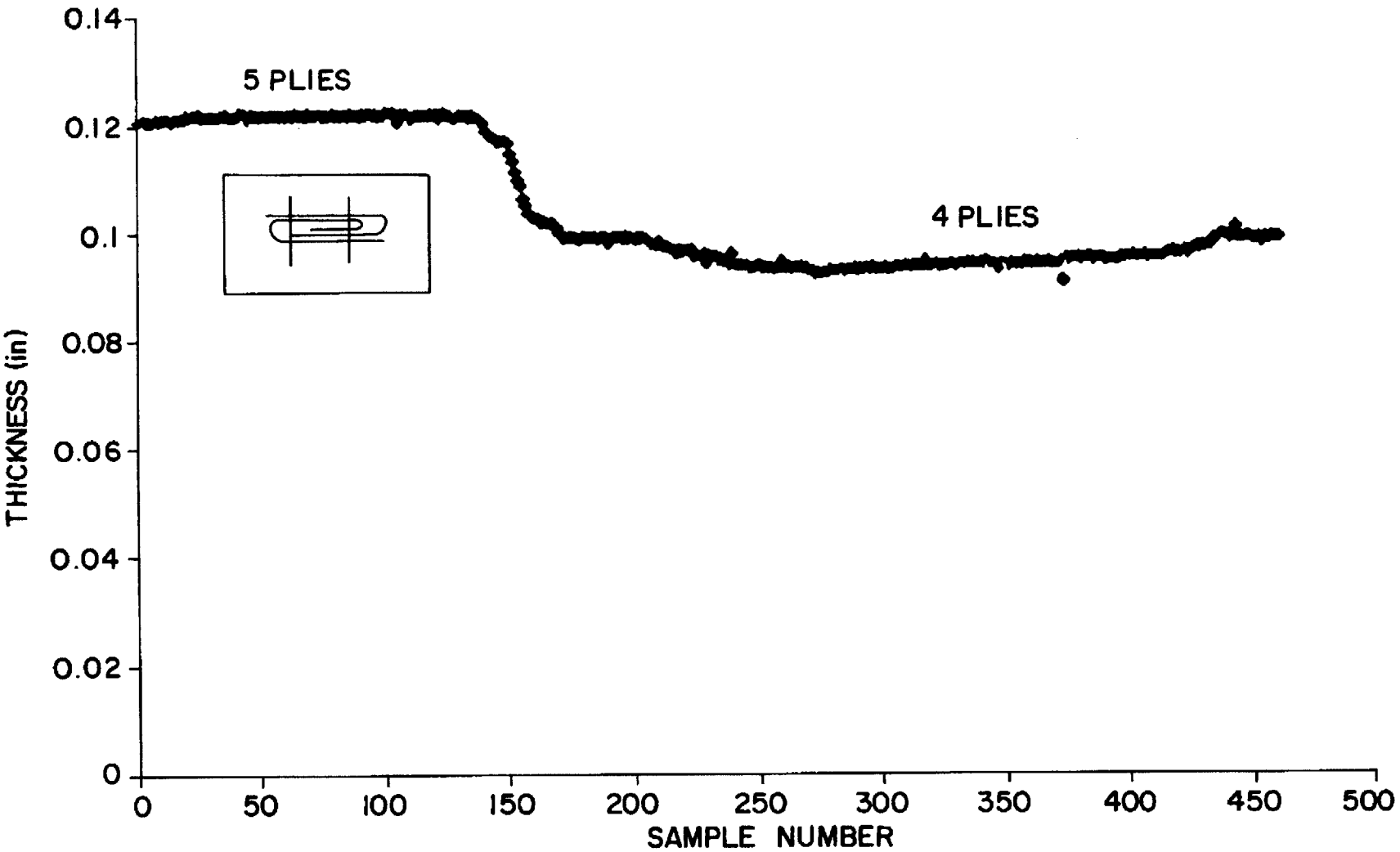
FIG. 14 is a thickness graph of a visually acceptable felled denim seam that is defective due to overstuffing.

FIG. 14: A Visually Acceptable Felled Seam, Defective Due to Overstuffing

At first, the felled seam appears acceptable from visual inspection, however, a closer examination reveals that the edges of the 4.0 inch wide strips do not remain parallel. Consistently, data from apparatus 30 confirmed that one end of the seam is overstuffed and contained 5 plies of data. Although the extra stuffing may not oppose a direct threat by creating a blowout, it can jeopardize seam quality by providing extra stress on the stitching and creating a bulkier seam.

Figure 15:
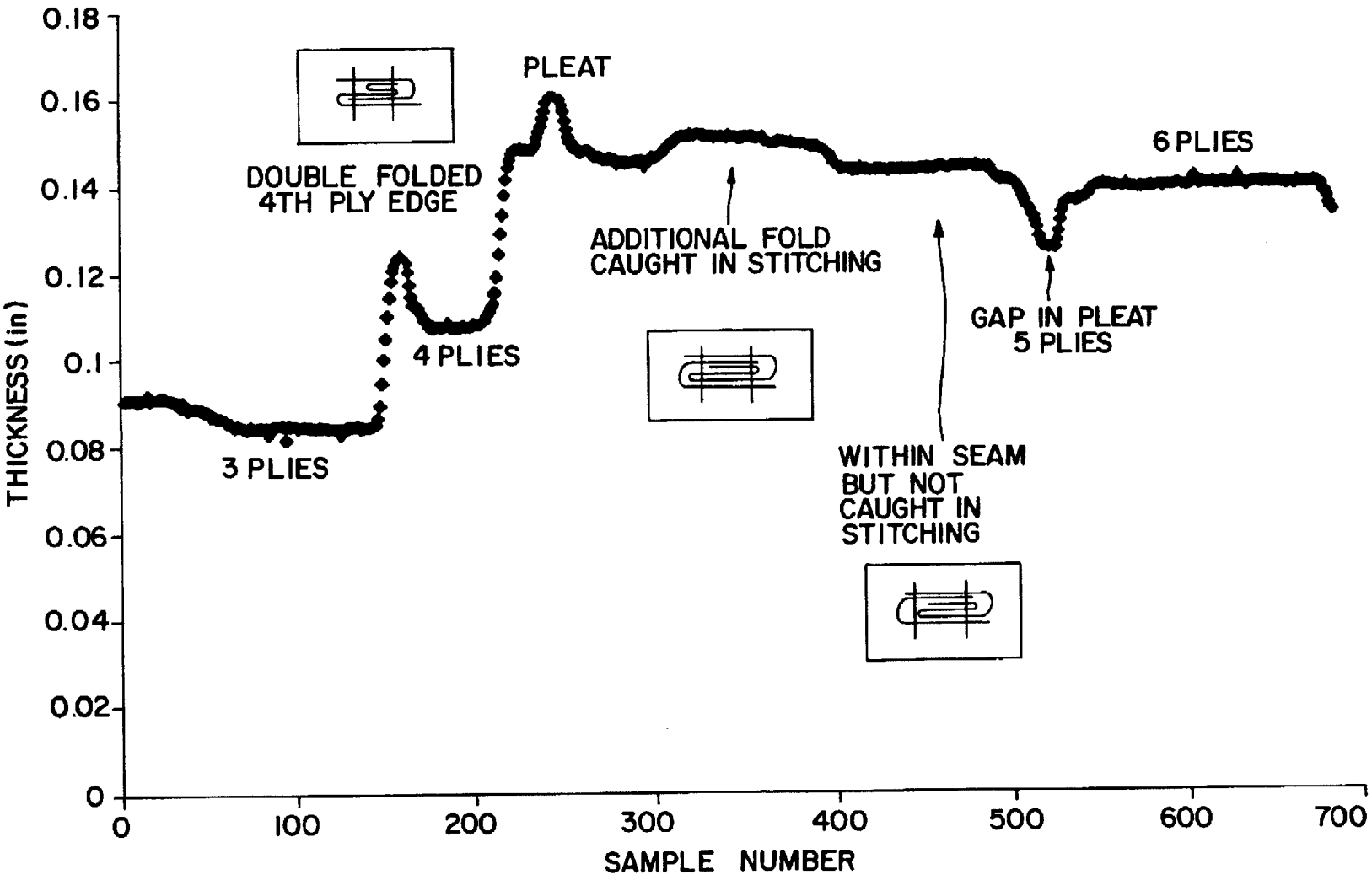
FIG. 15 is a thickness graph of a defective felled denim seam illustrating a variety of sewn seam defects.

FIG. 15: A Defective Felled Seam

Puckering and overstuffing are visually evident for the felled seam. In a graph resembling a sewing operator's worst case scenario, each additional fold and pleat within the seam are indicated. Although such a seam might be caught and resewn by a skilled operator's eye, it nevertheless serves as an illustrative example to the sensitivity and flexibility of apparatus 30.

Figure 16:
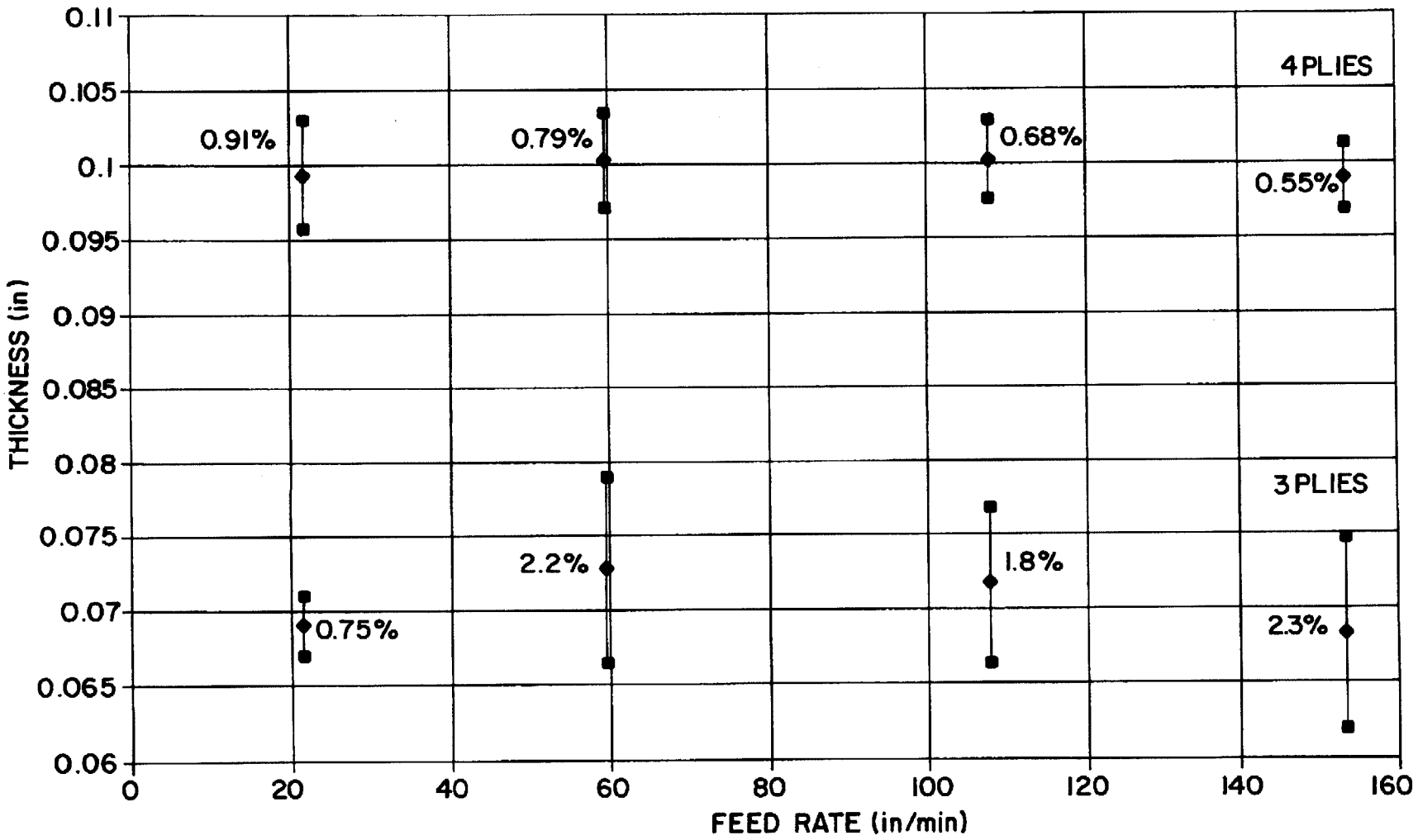
FIG. 16 is a graph of average ply thickness versus speed rate for a representative felled denim seam.

Variation in the data characteristics due to the speed at which the sample is moving beneath apparatus wheel 36 has also been studied. FIG. 16 indicates the average thickness and four standard deviations for three and four plies of denim secured within a felled seam, tested at feed rates ranging from 22 to 153 inches/minute. Average thicknesses at the different feed rates vary only 3% with a range of CVs from 0.55% to 2.3%, indicating that the data is consistent regardless of feed rate.

Second Embodiment of the Invention

As a second embodiment of the instant invention, applicants have mounted an automatic sewn seam monitoring apparatus 30 on a UNION SPECIAL side-arm sewing unit (see FIG. 17), although apparatus 30 could be mounted to any similar sewing machine as may be desired. Only minimal alterations were required to mount the apparatus to the sewing machine. Only the small, lightweight thread guard which covers the cutter opening was removed. Quite simply, a 0.75 inch extension bar 43 is added between the end of the machine behind the puller wheel PW and the thread cutter TC. For sewing machines utilizing a cutter shaft, it may be necessary to lengthen the cutter shaft to allow for complete cutter function. The top surface of extension bar 43 contains a groove (not shown) to help guide the seam as it passes under wheel 36 of apparatus 30. The thickness of extension bar 43 was minimized to best localize the sewn seam and to avoid undesirable bunching of the seam between the device and puller wheel PW.

Mounting plate 39, wheel 36, and wheel bracket 34 have been redesigned as illustrated in FIG. 17 so as to allow mounting of apparatus 30 to sewing machine SM. Mounting plate 39 is attached with screws through the same tapped holes used to secure the bracket of the conventional presser spring regulator R. The new wheel bracket 34 is L-shaped to locate the wheel directly behind puller wheel PW. Wheel 36 now possesses a 0.625 inch diameter in order to adapt to the vertical spacing between extension bar 43 and the puller wheel shaft and the horizontal spacing between the puller wheel edge and the cutter plate (not shown). Wheel 36 and wheel bracket 34 are machined from steel rather than aluminum for strength and durability. The additional mass must be included into the calculation of the force applied to fabric samples.

Apparatus 30 shown in FIG. 17 can be shielded from the industrial plant environment with a 1.75 inch×5.0×2.50 inch housing. Wheel bracket 34 extends another 3.0 inches below the housing to make contact with extension bar 42, approximately 2.0 inches behind the sewing needle and 0.25 inches from puller wheel PW.

Electrical connections for LVDT 32 and compressed air lines for the air cylinders (not shown) are secured along the body of sewing machine SM near its attachment to a pedestal stand (not shown). A pressure regulator (not shown) is mounted wherein other oil and air pressure gauges are normally located, and the amp and a switch (not shown) for air cylinder 43 are located nearby. The computer (e.g., a PC) should be positioned near the operator, and the computer may be replaced by a microprocessor unit to render apparatus 30 with more functional capabilities for both monitoring and controlling sewing operations.

Sewing machine monitoring apparatus 30 is fully functional and capable of monitoring seam quality at normal sewing speeds. Currently, the voltage signal from the LVDT amp is collected with NATIONAL INSTRUMENTS brand LabVIEW® software on the PC. As noted previously, the computer can be replaced by a microprocessor unit which will both control and monitor the signal from apparatus 30.

Applicants wish to note that in the detailed description set forth hereinabove, all examples of testing and use of the seam quality monitoring invention were for denim fabric seams. However, applicants contemplate that the invention can be used for determining seam characteristics for any type of textile fabric or similar sheet material having a seam formed therein. More specifically, applicants contemplate that the invention could be used to analyze joined seams formed in many different ways from many different materials including but not limited to the following: (1) sewn seams formed from a plurality of textile fabric plies; (2) seams formed from ultrasonically, thermally or chemically bonded non-woven fabric sheets; (3) seams formed from thermally welded or resin bonded rubber sheets; and (4) seams formed from thermally bonded plastic sheets.

It will be understood that various details of the invention may be changed without departing from the scope of the invention. Furthermore, the foregoing description is for the purpose of illustration only, and not for the purpose of limitation—the invention being defined by the claims.

What is claimed is:

1. A seam monitoring system for evaluating seams formed by stitching together a plurality of elements of sheet material, and comprising:

(a) quality sensing means for continuously compressing and monitoring the quality of a seam, said quality sensing means being positioned so that a seam moving in the direction of its longitudinal axis passes continuously beneath said quality sensing means; and (b) computer means electrically connected to said quality sensing means for analyzing the seam to detect predetermined characteristics thereof.

2. A seam monitoring system according to claim 1 wherein said thickness sensing means comprises a wheel, said wheel being vertically moveable from an inoperative mode above the seam to an operative mode in contact with the seam passing therebeneath, a transducer operatively connected to said wheel for measuring vertical movement of said wheel, and means for urging said wheel against the seam passing therebeneath.

3. A seam monitoring system according to claim 2 wherein said transducer comprises a linear variable differential transducer (LVDT).

4. A seam monitoring system according to claim 3 including a signal amplifier in electrical connection between said LVDT and said computer means.

5. A seam monitoring system according to claim 2 wherein said means for urging said wheel comprises an air cylinder operatively connected to said wheel.

6. A seam monitoring system according to claim 1 wherein said computer means comprises a personal computer (PC).

7. A seam monitoring system according to claim 1 wherein said computer means comprises a microprocessor.

8. A seam monitoring system according to claim 1 wherein said computer means is programmed to both analyze the seam and to control selected seam forming functions in response thereto.

9. In combination with a sewing machine of the type adapted to stitch together seams, a seam quality monitoring system comprising:

(a) quality sensing means for continuously compressing and monitoring the quality of a seam being sewn, said quality sensing means being positioned so that a seam moving in the direction of its longitudinal axis passes continuously beneath said quality sensing means, said quality sensing means comprising a vertically movable wheel adapted to move from an inoperative mode above the sewn seam to an operative mode in contact with the sewn seam therebeneath, a transducer operatively connected to said wheel to measure vertical movement of said wheel, and means for urging said wheel against the sewn seam passing therebeneath; and (b) computer means electrically connected to said quality sensing means for analyzing the seam being sewn to detect predetermined characteristics thereof sensed by said wheel when in its operative mode in contact with the sewn seam passing therebeneath.

10. The combination according to claim 9 wherein the sewing machine is a side arm sewing machine comprising a puller wheel.

11. The combination according to claim 9 wherein said transducer comprises a linear variable differential transducer (LVDT).

12. The combination according to claim 11 including a signal amplifier in electrical connection between said LVDT and said computer means.

13. The combination according to claim 9 wherein said means for urging said wheel comprises an air cylinder operatively connected to said wheel.

14. The combination according to claim 9 wherein said computer means comprises a personal computer (PC).

15. The combination according to claim 9 wherein said computer means comprises a microprocessor.

16. The combination according to claim 9 wherein said computer means is programmed to both analyze the seam being sewn and to control selected sewing functions in response thereto.

17. A method for monitoring predetermined characteristics of a seam with a monitoring system wherein said seam is formed by stitching together a plurality of elements of sheet material, comprising the steps of:

(a) moving a seam in the direction of its longitudinal axis so that it passes continuously beneath a vertically displaceable roller;

(b) urging the vertically displaceable roller against the seam and compressing the seam as the seam passes continuously therebeneath;

(c) detecting the vertical displacement of said roller as the seam passes continuously therebeneath and continuously generating a signal corresponding thereto; and (d) analyzing said signal with computer means to continuously detect predetermined characteristics along the length of the seam.

18. A method according to claim 17 including urging said vertically moveable roller against the seam with an air cylinder.

19. A method according to claim 17 including detecting the vertical movement of said roller with a linear variable differential transducer (LVDT) and generating a signal corresponding thereto with said LVDT.

20. A method according to claim 17 including analyzing said signal with a personal computer (PC).

21. A method according to claim 17 including analyzing said signal with a microprocessor.

22. A method according to claim 17 including both analyzing the seam and controlling selected sewing functions in response thereto.

23. A method according to claim 17 including providing the monitoring system directly mounted to a sewing machine.

24. A method according to claim 17 including providing the monitoring system operatively associated with but detached from a sewing machine.

25. A method for monitoring the quality of a stitched seam from a sewing machine with a quality monitoring system mounted thereto wherein said sewing machine is of the type adapted to stitch together seams, comprising the steps of:

(a) moving a seam in the direction of its longitudinal axis so that it passes continuously beneath a vertically displaceable roller;

(b) urging the vertically movable roller against the seam being sewn and compressing the seam as the sewn seam continuously passes therebeneath;

(c) detecting the vertical movement of said roller as the sewn seam passes continuously therebeneath with a linear variable differential transducer (LVDT) and generating a signal from said LVDT corresponding thereto; and (d) analyzing said signal from said LVDT with computer means to continuously detect any defects along the length of the sewn seam.

26. A method according to claim 25 including urging said vertically movable roller against the seam being sewn with an air cylinder.

27. A method according to claim 25 including analyzing said signal with a personal computer (PC).

28. A method according to claim 25 including analyzing said signal with a microprocessor.

29. A method according to claims 25 including both analyzing the seam being sewn and controlling selected sewing functions in response thereto.

* * * * *